US012185781B1

(12) United States Patent
Lian

(10) Patent No.: US 12,185,781 B1
(45) Date of Patent: Jan. 7, 2025

(54) HAIR WEFT AND PREPARATION PROCESS OF

(71) Applicant: WELLNA CO., LTD, Kl (HK)

(72) Inventor: Xiangpeng Lian, Rongcheng (CN)

(73) Assignee: WELLNA CO., LTD, Kl (HK)

( * ) Notice: Subject to any disclaimer, the term of this patent is extended or adjusted under 35 U.S.C. 154(b) by 0 days.

(21) Appl. No.: 18/776,261

(22) Filed: Jul. 18, 2024

Related U.S. Application Data

(63) Continuation of application No. 18/410,869, filed on Jan. 11, 2024.

(51) Int. Cl.
*A41G 5/00* (2006.01)

(52) U.S. Cl.
CPC ..... *A41G 5/0046* (2013.01)

(58) Field of Classification Search
CPC .... A41G 5/004; A41G 5/0046; A41G 5/0053; A41G 5/008
See application file for complete search history.

(56) References Cited

U.S. PATENT DOCUMENTS

| | | | | |
|---|---|---|---|---|
| 10,058,138 | B2 * | 8/2018 | Alex | A41G 5/0053 |
| 2014/0326267 | A1 * | 11/2014 | Peterson | A41G 5/0046 132/201 |
| 2023/0040318 | A1 * | 2/2023 | Hirano | A41G 5/0046 |
| 2023/0109742 | A1 * | 4/2023 | Gray | A41G 5/0046 132/201 |

* cited by examiner

*Primary Examiner* — Rachel R Steitz
(74) *Attorney, Agent, or Firm* — Ying-Ting Chen

(57) ABSTRACT

The present disclosure relates to technical field of hairdressing supplies manufacturing, and more specifically to a hair weft. The hair weft includes a first hair weft and a second hair weft; the second hair weft is cut and affixed flush to a bottom of the first hair weft, forming the hair weft. The preparation process includes providing a hair transplantation base, a first hair strand, a first hair weft, a second hair weft, a finished hair weft, and cleaning and processing.

6 Claims, 3 Drawing Sheets

HAIR WEFT AND PREPARATION PROCESS OF

CROSS REFERENCE

This is a Continuation Application that claims the benefit of priority under 35U.S.C. § 120 to a non-provisional application, application Ser. No. 18/410,869, filed date Jan. 11, 2024, which is a non-provisional application that claims the benefit of foreign priority to Chinese Patent Application No. 202311804410.7, filed date Dec. 25, 2023, the entire contents of which are hereby incorporated by reference in their entirety.

TECHNICAL FIELD

The present disclosure relates to technical field of hairdressing supplies manufacturing, and more specifically to a hair weft.

BACKGROUND

The importance that people place on their appearance is increasing, and more and more people want to be able to change their image by changing their hairstyle. However, due to the limitations of factors such as the growth cycle and quality of hair, many people are unable to fulfill their personal hairstyle needs. In this case, hair extensions become people's first choice. As the most traditional product type in the hair product industry, hair weft has a place in the market for its wide coverage area on the head and large volume of hair.

Currently on the market, the hair weft is mostly handmade or machine-made, but the hair wefts prepared by the two production methods have obvious weft edge, which has a large thickness affecting the wearing comfort, and is not invisible enough causing obvious appearances. Further, both the above two kinds of hair wefts have folded hair, and the folded-back short hair will be in contact with the scalp when the wearer activities, resulting in a tingling sensation.

The CN Patent No. CN108835745A discloses a hair extension piece simulating human hair and a preparation method thereof. The hair extension piece includes a substrate, a hair strand, where an end of the hair strand passes through the substrate and is fixed to a back side of the substrate through an adhesive; the hair strand is flatly affixed to a front side of the substrate and is perpendicular to a length direction of the substrate. The preparation method includes: 1) making/preparing a substrate; 2) preparing a spacer; 3) preparing a hair transplantation marking area/marking paper; 4) binding auxiliary materials; 5) preparing a hair strand for hair transplantation; 6) hair transplantation; 7) cutting; 8) fixing; 9) finished product cutting: the substrate after smearing and baking is cut into the desired shape by using scissors or a knife mold; and the finished hair extension piece is thus made. The advantage is that the front side of the hair extensions made by the CN Patent is not required to be fixed by glue. However, the CN Patent has disclosed the production method of the hair extension pieces but not disclosed the production method of hair wefts, and thus cannot solve the problem that the hair wefts have obvious weft edge, which has a large thickness affecting the wearing comfort, and is not invisible enough causing obvious appearances; the hair wefts have folded hair, and the folded-back short hair will be in contact with the scalp when the wearer activities, resulting in a tingling sensation.

SUMMARY OF THE DISCLOSURE

The present disclosure is intended to solve at least one of the technical problems of the prior art. To this end, a first aspect of the present disclosure proposes a hair weft, including:

a first hair weft, including a hair transplantation base and a first hair strand; wherein the hair transplantation base includes a mesh base and a spacer disposed above the mesh base; the spacer is configured to clamp the first hair strand after the first hair strand passes through the mesh base and the spacer; the mesh base is configured to affix the first hair strand to a side of the mesh base after the spacer and the mesh base are separated; and a second hair weft, including a second hair strand; wherein a top of the second hair strand is fixed through a quilting line and a glue; wherein the second hair weft is cut and affixed flush to a bottom of the first hair weft, forming the hair weft.

In some embodiments, a material of the mesh base is a non-stretchy, densely perforated, ultra-thin mesh silk yarn.

In some embodiments, a material of the spacer is PVC artificial leather.

The embodiments of the present disclosure further propose a preparation method of the hair weft, including:

Step 1, preparing the hair transplantation base: cutting the mesh base and the spacer to a predetermined shape, marking a hair transplantation area on the spacer, and aligning the mesh base and the spacer to be bound together;

Step 2, preparing the first hair strand and placing the first hair strand in a predetermined area;

Step 3, preparing the first hair weft: after passing the first hair strand placed in the predetermined area through the spacer and the mesh base, cutting the first hair strand disposed between the spacer and the mesh base, fixing the first hair strand on a side of the mesh base, and cutting the first hair strand on the other side of the mesh base shorter, to obtain the first hair weft;

Step 4: preparing the second hair weft: fixing a top of the second hair strand that is organized to a same height through two quilting lines and further fixing with the glue;

Step 5, preparing the hair weft: cutting the first hair weft and the second hair weft, and affixing the second hair weft flush to the bottom of the first hair weft; and Step 6, cleaning treatment: soaking the hair weft in an alkaline solution, and soaking the hair weft in a softener.

In some embodiments, the Step 2 includes:

organizing the first hair strand to a uniform height;

fixing a middle part of the first hair strand;

placing the first hair strand in a transplantation area of a transplantation machine; and placing the mesh base and the spacer in turn above the transplantation area.

In some embodiments, the Step 3 includes:

utilizing a curved hook at a top of a transplantation machine to sequentially hook the first hair strand located below the mesh base in the hair transplantation area, and utilizing the spacer to clamp the first hair strand until the first hair strand is completely transplanted in the hair transplantation area;

cutting the first hair strand located between the spacer and the mesh base, affixing the first hair strand to the mesh base through an adhesive, and drying; and cutting the first hair strand on the side of the mesh base away from the spacer to 0.1 to 2 cm, to obtain the first hair weft.

In some embodiments, the Step 4 includes:

organizing the second hair strand to a uniform height;

forming the two quilting lines on the top of the second hair strand through a double-needle sewing machine;

applying a tape 1.2 to 1.5 inches from the top of the second hair strand; and applying a preprepared glue to evenly coat the tape to the top of the second hair strand, and drying.

In some embodiments, the Step 6 includes:

putting 100 g of the hair weft into 1 kg of 40° C. water, adding 2 g to 3 g of sodium hypochlorite solution, and soaking for 5 minutes;

cleaning the hair weft for three times using 40° C. water;

after the cleaning, putting the hair weft into 1 kg of 50° C. water, adding 30 g of softener, and soaking for 10 minutes; and after the cleaning, putting the hair weft into 1 kg of 50° C. water, adding 40 g of softener, and soaking for 10 minutes.

The embodiments of the present disclosure provide a hair weft and a preparation process thereof, which have the following beneficial effects compared with the prior art:

By providing the hair transplantation base, the first hair strand, the first hair weft, the second hair weft, the finished hair weft, and cleaning and processing, a hair weft close to the state of human hair growth is obtained. There is no weft edge in the conventional sense of the traditional hair weft. After wearing, the hair weft blends in with the wearer's own hair, which is more invisible. No hair back occurs, which enhances the wearing experience, solving the problems of wearing discomfort caused by the weft edge being too thick and too hard, poor breathability, and irritation of the skin when wearing due to the issue of hair return, etc., and it is more invisible after wearing, which protects the privacy of the wearer more and enhances the wearing experience.

BRIEF DESCRIPTION OF THE DRAWINGS

In order to more clearly illustrate the technical solutions in the specific embodiments or related art of the present disclosure, the accompanying drawings to be used in the description of the specific embodiments or related art will be briefly introduced below. It will be obvious that the accompanying drawings in the following description are some of the embodiments of the present disclosure, and that for those skilled in the art, other attachments can be obtained based on these accompanying drawings without putting in creative labor.

DETAILED DESCRIPTION

The following will be a clear and complete description of the technical solutions in the embodiments of the present disclosure in conjunction with the accompanying drawings in the embodiments of the present disclosure. Obviously, the described embodiments are only a part of the embodiments of the present disclosure, and not all of them. Based on the embodiments in the present disclosure, all other embodiments obtained by those skilled in the art without creative labor fall within the scope of the present disclosure.

The present specification provides steps for operating the method as described in the embodiments or flowcharts, but more or fewer steps may be included based on routine or unoriginal labor. When executed in a real-world system or server product, the methods may be executed sequentially or in parallel (e.g., a parallel processor or multi-threaded processing environment) as shown in the embodiments or the accompanying drawings.

Figure 1:
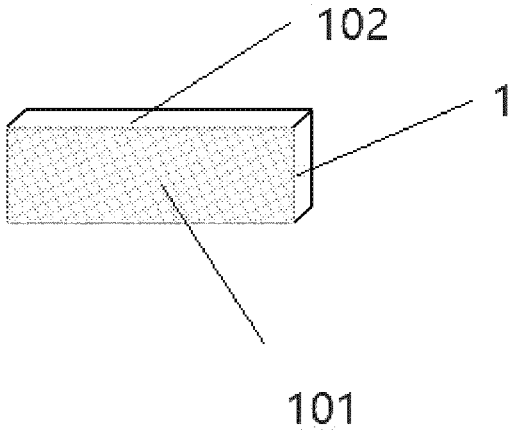
FIG. 1 is a structural schematic view of a hair transplantation base of a hair weft according to some embodiments of the present disclosure.
Figure 2:
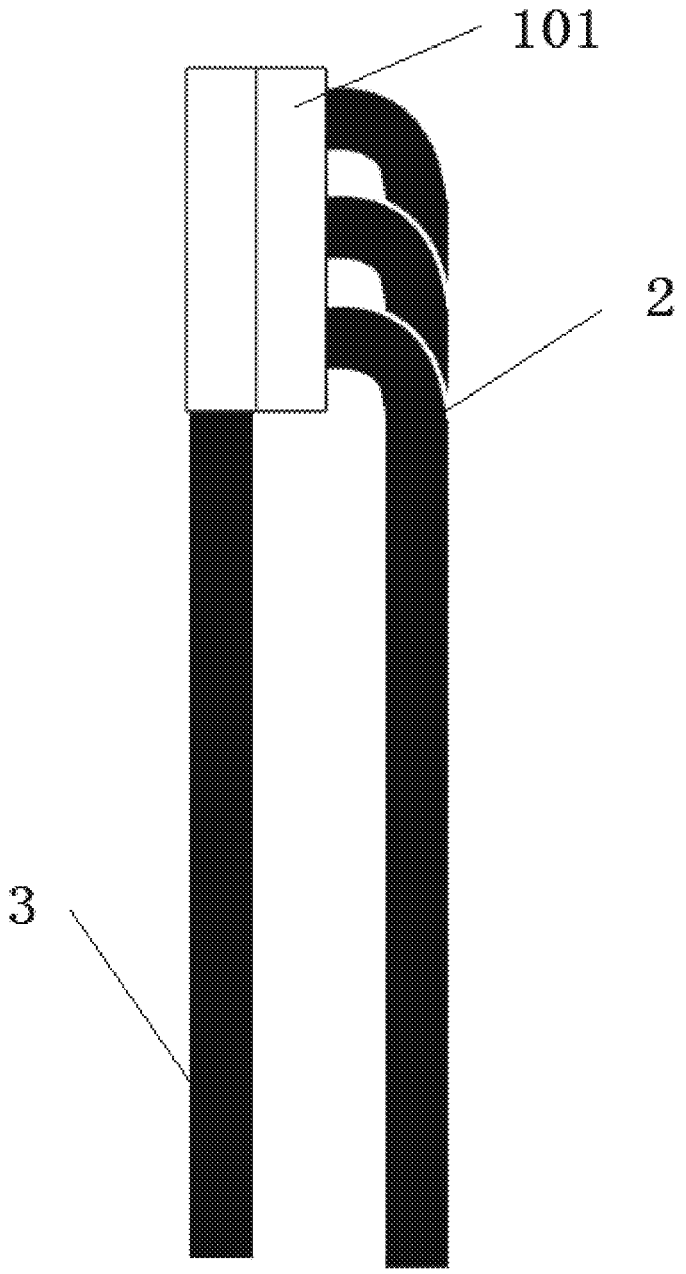
FIG. 2 is a structural schematic view of a first hair weft and a second hair weft of a hair weft after being affixed according to some embodiments of the present disclosure.

FIG. 1 is a structural schematic view of a hair transplantation base of a hair weft according to some embodiments of the present disclosure, and FIG. 2 is a structural schematic view of a first hair weft and a second hair weft of a hair weft after being affixed according to some embodiments of the present disclosure. The hair weft refers to skin weft, which can be directly braided onto the head. The embodiments of the present disclosure are intended to solve the problem that the hair wefts have obvious weft edge, which has a large thickness affecting the wearing comfort, and is not invisible enough causing obvious appearances; the hair wefts have folded hair, and the folded-back short hair will be in contact with the scalp when the wearer activities, resulting in a tingling sensation. Referring to FIGS. 1 and 2, the structure of the hair weft includes:

a first hair weft, including a hair transplantation base 1 and a first hair strand 2;

where the hair transplantation base 1 includes a mesh base 101 and a spacer 102 disposed above the mesh base 101; the spacer 102 is configured to clamp the first hair strand 2 after the first hair strand 2 passes through the mesh base 101 and the spacer 102; the mesh base 101 is configured to affix the first hair strand 2 to a side of the mesh base 101 after the spacer 102 and the mesh base 101 are separated;

a second hair weft, including a second hair strand 3; where a top of the second hair strand 3 is fixed through quilting line and glue;

where the second hair weft is cut and affixed flush to a bottom of the first hair weft to obtain the hair weft.

The present disclosure can solve the problem, that existing hair wefts have folded hair and the folded-back short hair will be in contact with the scalp when the wearer activities, resulting in a tingling sensation, by affixing the second hair weft at the bottom of the first hair weft in a flush-fit manner. Moreover, by fixing the first hair strand 2 to one side of the mesh base 101, the mesh base has no obvious weft edge, which has a smaller thickness and is comfortable to wear. The second hair weft made by the second hair strand 3 is attached to the bottom of the first hair weft to make the finished hair weft, which has the effect of being invisible, such that the hair weft is not obvious after being worn. Because the first hair weft has a low density and volume of hair transplantation and cannot satisfy our demand for a large volume of hair, the second hair weft with a relatively large volume of hair is additionally made, and the first and second hair wefts are affixed together by means of an adhesive. To make the hair weft, the first and second hair wefts are placed vertically, and then the roots of the two hair wefts are affixed together by means of the adhesive.

In some embodiments, the material of the mesh base 101 is a non-stretchy, densely perforated, ultra-thin mesh silk yarn.

In the embodiments, the silk yarn may be Korean silk. The silk yarn is selected from the short fibers of silk by spinning and regeneration. Goods made from silk yarn or yarn woven in a plain arrangement are called silk. The texture of silk is tight and frivolous, with fine and clean surface, lubricating and flat, glossy and soft, to be used as clothing material and decorative items. Korean silk is one of the series of silk fabrics produced by combining the characteristics of Korean silk products with Chinese weaving technology. The mesh base 101 made of Korean silk has no visible weft edges, which is less thick and is comfortable to wear.

In some embodiments, the material of the spacer 102 is PVC artificial leather.

The material of the spacer 102 in the embodiments is PVC artificial leather with a thickness of 0.4 mm. A curved hook carried at a top of a needle of a transplantation machine can pierce the spacer 102 and the mesh base 101 in turn when it moves up and down, and the curved hook at the top of the needle hooks the first hair strand 2 and brings the first hair strand 2 out of the pierced hole, and the spacer 102 shrinks after the needle has been withdrawn from the hole to clamp the first hair strand 2. The spacer 102 made of PVC artificial leather has better shrinkage and is cheap and easy to obtain.

Figure 3:
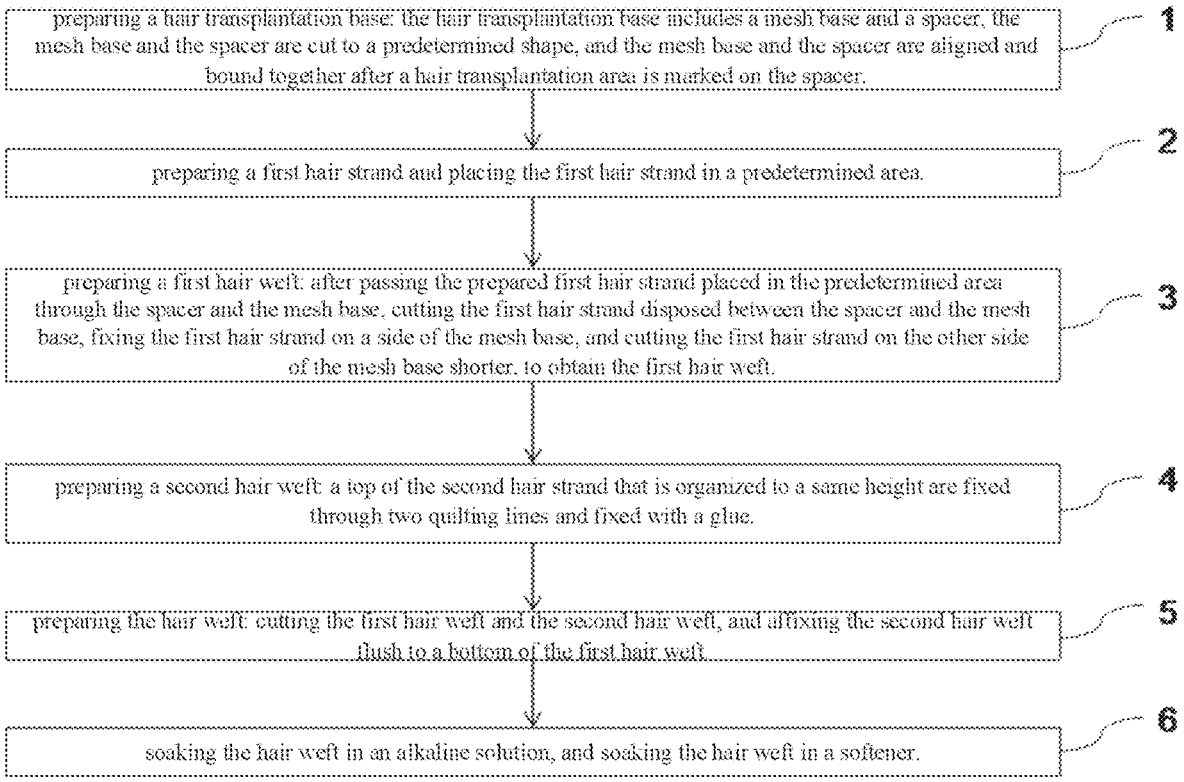
FIG. 3 is a flowchart of a preparation process of a hair weft according to some embodiments of the present disclosure.

FIG. 3 is a flowchart of a preparation process of a hair weft according to some embodiments of the present disclosure. Referring to FIG. 3, the embodiments of the present disclosure further provide a preparation process of a hair weft, including:

Step 1, preparing a hair transplantation base: the hair transplantation base includes a mesh base and a spacer, the mesh base and the spacer are cut to a predetermined shape, and the mesh base and the spacer are aligned and bound together after a hair transplantation area is marked on the spacer.

Specifically, the implementation steps of preparing the hair transplantation base include:

Step 101, cutting the mesh base and spacer to a desired shape and length.

Step 102, marking the desired hair transplantation area on the spacer with a marker.

Step 103, overlapping the mesh base and spacer, and binding and fixing the mesh base and the spacer with a stapler.

Step 2, preparing a first hair strand and placing the first hair strand in a predetermined area.

Specifically, the implementation steps of preparing a first hair strand and placing the first hair strand in the predetermined area include:

Step 201, organizing the first hair strand to a uniform height.

In step 201, a top of the first hair strand is tapped flush with a clapper board, and hair that is too short is lifted by hand to keep the overall height of the first hair strand consistent.

Step 202: fixing a middle part of the first hair strand.

In step 202, the middle part of the first hair strand is placed in two hair-beating splints with curved pins for fixing.

Step 203: placing the first hair strand in a transplantation area of a transplantation machine.

In step 203, the first hair strand is placed flat on top of the transplantation area of the transplantation machine.

Step 204: placing the mesh base and the spacer in turn above the transplantation area.

In step 204, the fabricated hair transplantation base is placed on top of the first hair strand, with the mesh base on the bottom and the spacer on the top.

Step 3, preparing a first hair weft: after passing the prepared first hair strand placed in the predetermined area through the spacer and the mesh base, cutting the first hair strand disposed between the spacer and the mesh base, fixing the first hair strand on a side of the mesh base, and cutting the first hair strand on the other side of the mesh base shorter, to obtain the first hair weft.

Specifically, the implementation steps of step 3 include:

Step 301, utilizing a curved hook at a top of a transplantation machine to sequentially hook the first hair strand located below the mesh base in the hair transplantation area, and utilizing the spacer to clamp the first hair strand until the first hair strand is completely transplanted in the hair transplantation area.

In step 301, a top of a needle of the transplantation machine is arranged with a curved hook, and the curved hook pierces the spacer 102 and the mesh base 101 in turn when the needle moves up and down; upon reaching the first hair strand, the curved hook on the top of the needle hooks some of the first hair strand, and brings the some of the first hair strand out of the pierced hole, and the spacer shrinks after the machine needle is withdrawn from the hole, to clamp the some of the first hair strand. Step 301 is repeated until the first hair strand is completely transplanted in the hair transplantation area.

Step 302, cutting the first hair strand located between the spacer and the mesh base, affixing the first hair strand to the mesh base through an adhesive, and drying.

In step 302, the hair transplantation base after the hair transplantation is completed is removed from the first hair strand, and the hair strand between the mesh base and the spacer is cut through scissors to separate the mesh base from the spacer. An adhesive is applied to the first hair strand and dried in an oven. The first hair strand on the back of the mesh base is pressed down and ironed it flat through an iron such that the first hair strand is parallel to the mesh base. The adhesive is applied again to the first hair strand on the back of the mesh base and dried in the oven.

Step 303: cutting the first hair strand on the side of the mesh base away from the spacer to 0.1 to 2 cm, to obtain the first hair weft.

In step 303, the first hair strand on the back of the mesh base is trimmed to 0.1 to 2 cm through electric push shears to obtain the first hair weft.

Step 4: preparing a second hair weft: a top of the second hair strand that is organized to a same height are fixed through two quilting lines and fixed with a glue.

Specifically, the implementation steps of step 4 include:

Step 401, tapping the top of the second hair strand flush with a clapper board, and hair that is too short is lifted by hand to keep the overall height of the second hair strand consistent.

Step 402, forming the two quilting lines on the top of the second hair strand through a double-needle sewing machine, to obtain a fixed preparatory hair weft.

Step 403, applying a masking tape 1.2 to 1.5 inches from a top of the preparatory hair weft to prevent the glue from penetrating into the second hair strand at a bottom during a subsequent brushing step, thereby achieving a shaping effect.

Step 404, mixing polyurethane glue, adhesive, and thinner in proportion to obtain a special glue for making the weft edge.

Step 405, applying the glue at a position above the masking tape, utilizing a scraper to repeatedly scrape the glue such that the glue contacts the second hair strand uniformly for fixing, and placing the second hair weft in an oven for drying.

Step 406, repeating step 405 three times to obtain the second hair weft.

Step 5, preparing the hair weft: cutting the first hair weft and the second hair weft, and affixing the second hair weft flush to a bottom of the first hair weft.

Specifically, the implementation steps of step 5 include:

Step 501, cutting the first hair weft and the second hair weft to production specifications.

Step 502, affixing the second hair weft flush to the bottom of the first hair weft to obtain the hair weft.

In step 502, the first hair weft and the second hair weft are placed vertically, and then the roots of the two hair wefts are affixed together by an adhesive.

Step 6, cleaning treatment: soaking the hair weft in an alkaline solution, and soaking the hair weft in a softener.

Specifically, the implementation steps of step 6 include:

Step 601, putting 100 g of the hair weft into 1 kg of 40° C. water, adding 2 g to 3 g of sodium hypochlorite solution, and soaking for 5 minutes.

Step 602: cleaning the hair weft for three times using 40° C. water.

Step 603: after the cleaning, putting the hair weft into 1 kg of 50° C. water, adding 30 g of softener, and soaking for 10 minutes.

Step 604: after the cleaning, putting the hair weft into 1 kg of 50° C. water, adding 40 g of softener, and soaking for 10 minutes.

The purpose of step 601 to step 604 is to make the product softer and smoother and eliminate static electricity.

After step 6, step 7 of drying treatment and packaging treatment is further implemented for easy storage.

Specifically, the implementation steps of step 7 include:

Step 701, after the soaking, putting the hair weft into a centrifuge for dewatering and shaking, combing the hair weft through a dense-toothed comb, scraping off floating hairs on the hair weft, putting the hair weft into the water to be slightly wetted, unfolding and flatly laying the hair weft onto an iron plate, scraping off excess water through a brush, and putting the hair weft into a drying room at 50° C. for drying.

Step 702, finishing and packaging: after drying, ironing, combing, and folding into wefts, bundling and packaging the hair weft.

The appearance of the hair weft prepared by this process is similar to the wearer's own hair, and there is no weft edge in the conventional sense of the traditional hair weft, which solves the problems of wearing discomfort caused by the weft edge being too thick and too hard, poor breathability, and irritation of the skin when wearing due to the issue of hair return, etc., and it is more invisible after wearing, which protects the privacy of the wearer more and enhances the wearing experience.

It is to be noted that the hair weft product made by the present disclosure can be worn by sewing/pasting clips to make a clip hair product, or it can be worn by pasting a double-sided adhesive on the second hair weft and cutting.

It is to be noted that in this document, relational terms such as first and second are used only to distinguish one entity or operation from another, and do not necessarily require or imply the existence of any such actual relationship or order between these entities or operations. Furthermore, the terms "including", "having", or any other variant thereof, are intended to cover non-exclusive inclusion, such that a process, method, article, or apparatus including a set of elements includes not only those elements, but also other elements not expressly listed, or elements that are inherent to such process, method, article, or apparatus may be included. Without further limitation, the fact that an element is defined by the phrase "including a . . . " does not exclude the existence of another identical element in the process, method, article, or apparatus including the element.

Each of the embodiments in this specification is described in a related manner, and it is sufficient to refer to each embodiment for similarities between embodiments, and each embodiment focuses on the differences from other embodiments. In particular, for a system embodiment, since it is basically similar to the method embodiment, it is described in a simpler manner, and it is sufficient to refer to a part of the description of the method embodiment where relevant.

The above description is only some embodiments of the present disclosure, and is not intended to limit the scope of the present disclosure. Any modifications, equivalent substitutions, improvements, etc. made within the spirit and principles of the present disclosure are included in the scope of the present disclosure.

What is claimed is:

1. A preparation method of a hair weft, comprising the following steps:

(a) preparing a first hair weft comprising a first hair strand and a mesh base, wherein the first hair strand is affixed on the mesh base; and (b) affixing a top of a second hair strand of a second hair weft to the mesh base;

wherein the step (a) comprises the steps of:

cutting the mesh base and a spacer to a predetermined shape, marking a hair transplantation area on the spacer, and aligning the mesh base and the spacer to be bound together;

preparing the first hair strand and placing the first hair strand in a predetermined area; and preparing the first hair weft: after passing the first hair strand placed in the predetermined area through the spacer and the mesh base, cutting the first hair strand disposed between the spacer and the mesh base, fixing the first hair strand on a side of the mesh base, and cutting the first hair strand on the other side of the mesh base shorter to obtain the first hair weft.

2. The preparation method, as recited in claim 1, wherein the step (b) comprises the steps of:

preparing the second hair weft: fixing the top of the second hair strand that is organized to a same height and further fixing with a glue; and cutting the first hair weft and the second hair weft, and affixing the second hair weft to a bottom of the first hair weft.

3. The preparation method, as recited in claim 2, further comprising a step of cleaning treatment: soaking the hair weft in an alkaline solution, and soaking the hair weft in a softener.

4. The preparation method, as recited in claim 3, wherein the step of cleaning treatment comprises the following steps:

putting 100 g of the hair weft into 1 kg of 40° C. water, adding 2 g to 3 g of sodium hypochlorite solution, and soaking for 5 minutes;

cleaning the hair weft for three times using 40° C. water, after the cleaning, putting the hair weft into 1 kg of 50° C. water, adding 30 g of softener, and soaking for 10 minutes; and after the cleaning, putting the hair weft into 1 kg of 50° C. water, adding 40 g of softener, and soaking for 10 minutes.

5. The preparation method, as recited in claim 1, wherein the step of preparing the first hair strand and placing the first hair strand in the predetermined area comprises the following steps:

organizing the first hair strand to a uniform height;

fixing a middle part of the first hair strand;

placing the first hair strand in a transplantation area of a transplantation machine; and placing the mesh base and the spacer in turn above the transplantation area.

6. The preparation method, as recited in claim 5, wherein the step of preparing the first hair weft comprising the following steps:

utilizing a curved hook at a top of a transplantation machine to sequentially hook the first hair strand located below the mesh base in the hair transplantation area, and utilizing the spacer to clamp the first hair strand until the first hair strand is completely transplanted in the hair transplantation area.

* * * * *